US011227513B2

(12) United States Patent
Silverman

(10) Patent No.: US 11,227,513 B2
(45) Date of Patent: Jan. 18, 2022

(54) HOLDING DEVICE WITH FLEXIBLE ADAPTER

(71) Applicant: Daniel Silverman, Falls Church, VA (US)

(72) Inventor: Daniel Silverman, Falls Church, VA (US)

( * ) Notice: Subject to any disclaimer, the term of this patent is extended or adjusted under 35 U.S.C. 154(b) by 0 days.

(21) Appl. No.: 17/120,479

(22) Filed: Dec. 14, 2020

(65) Prior Publication Data

US 2021/0097896 A1 Apr. 1, 2021

Related U.S. Application Data

(63) Continuation of application No. 16/555,879, filed on Aug. 29, 2019, now Pat. No. 10,867,528.

(60) Provisional application No. 62/724,306, filed on Aug. 29, 2018, provisional application No. 62/781,154, filed on Dec. 18, 2018.

(51) Int. Cl.

| | |
|---|---|
| ***G09F 3/20*** | (2006.01) |
| *B43K 23/02* | (2006.01) |
| *B43K 23/00* | (2006.01) |

(52) U.S. Cl.

CPC ..... *G09F 3/20* (2013.01); *B43K 23/00* (2013.01); *B43K 23/02* (2013.01); *G09F 3/207* (2013.01)

(58) Field of Classification Search

CPC .... G09F 3/20; G09F 3/207; G09F 2007/1852; B43K 23/00; B43K 25/02; B43K 25/024; B43K 25/026

See application file for complete search history.

(56) References Cited

U.S. PATENT DOCUMENTS

| | | | | |
|---|---|---|---|---|
| 4,944,624 | A * | 7/1990 | Garland | B43K 23/126 211/69.1 |
| 6,264,080 | B1 * | 7/2001 | Ewing | A45F 5/02 224/197 |
| 6,626,334 | B2 * | 9/2003 | Ewing | A45F 5/02 224/197 |
| 7,267,504 | B2 * | 9/2007 | Brooks | B43K 23/001 401/131 |
| 7,909,528 | B2 * | 3/2011 | Brooks | B43K 23/00 401/131 |
| 2004/0148740 | A1 * | 8/2004 | Arnone | B43K 25/00 24/11 FE |
| 2012/0195673 | A1 * | 8/2012 | Brooks | A47K 1/09 401/131 |
| 2016/0176226 | A1 * | 6/2016 | Chatterton | A45C 11/182 24/67.11 |

(Continued)

*Primary Examiner* — Gary C Hoge

(74) *Attorney, Agent, or Firm* — Attentive Law; Paul Ratcliffe

(57) ABSTRACT

The invention provides a portable display apparatus. The portable display apparatus includes a clipstand that attaches to a barreled device and is used to display information, including holding other metal-backed items. The clipstand surface has a magnet embedded so that different faces can be attached to the clip surface and allow different information to be displayed, and different items to be held. The present invention also includes a clear plastic sleeve, the tag, attached to a metal bar to allow the tag to stick to the magnet. Different cards can be placed into the tag, and the tag may be written on with an erasable marker to allow for different displays. The clipstand may be displayed on a table attached to a barreled instrument or worn on a lanyard.

15 Claims, 10 Drawing Sheets

(56) References Cited

U.S. PATENT DOCUMENTS

2019/0337324 A1* 11/2019 Black ..... A45F 5/022

* cited by examiner

HOLDING DEVICE WITH FLEXIBLE ADAPTER

RELATED PATENT APPLICATION AND PRIORITY

This application is a continuation of U.S. patent application Ser. No. 16/555,879, filed Aug. 29, 2019, which claims priority to U.S. Provisional Patent Application 62/724,306 filed Aug. 29, 2018 and also claims priority to U.S. Provisional Patent Application 62/781,154 filed Dec. 18, 2018, each of which are incorporated herein by reference in its entirety.

BACKGROUND OF THE INVENTION

Field of the Invention

The present invention relates generally to a display device which includes a clipstand, barreled instrument, tag, and lanyard that is used as a magnetic platform to hold advertisements and other metal-backed items. More specifically, the invention relates to a clipstand that caps onto a writing or other similarly barreled device, and allows the clipstand to serve as a platform for a metal-backed item, name tag, name tent, or other design advert using tags mounted onto the clipstand. The display device can be hung from a lanyard for an alternative way for user to display image or item on Clipstand.

SUMMARY OF THE INVENTION

This summary of the invention is provided to introduce concepts in a simplified form that are further described in the detailed description of the invention. This summary is not intended to identify key or essential inventive concepts of the claimed subject.

The present invention provides a clipstand that attaches to a writing device and is used to display information, including holding other metal-backed items. In a first embodiment of the present invention, the clip may have a magnet embedded in the clip panel or display panel so that different faces can be attached to the clip panel surface and allow different information to be displayed, and different items to be held. The first embodiment of the clipstand, a clear plastic sleeve, which may have a metal plate or a metal bar in the sleeve, is configured to attach to the clip panel of the clipstand to allow the metal plate in the sleeve to stick to the magnet embedded in the clip panel. Different cards can be placed into the sleeve or tag to act as a name tag. Alternatively, the sleeve or tag may be written on with an erasable marker to allow for writing in a name or for creating different displays. The clipstand may be attached to a barreled instrument (i.e. a pen or pencil) using an adapter allowing the pen to be inserted into a shirt pocket with the clip panel and tag folder over the outside of the pocket to act as a name tag, to extend the clip and be propped on a table or worn on a lanyard.

However, the clipstand does not need or is not limited to the plastic sleeve and magnetic clip panel configuration. In a alternative embodiment of the present invention the clip panel may be modified to accept alternative devices such as a bottle opener, a clasp (to grab and support a phone or tablet), a watch head or clock, a specially shaped insert to lock into a receiving indentation in a cell phone or tablet case. These alternative devices can either be attached to the clip panel or the clip panel can be removed, and the alternative devices can be configured to attach to the clipstand hinge assembly directly. In another alternative embodiment the clip panel may be modified further by the attachment of a second clip panel. The second clip panel may have a permanent fixture on it and can be attached to the clip panel, allowing for easy interchangeable displays.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein.

DETAILED DESCRIPTION OF EXEMPLARY EMBODIMENTS

Figure 1:
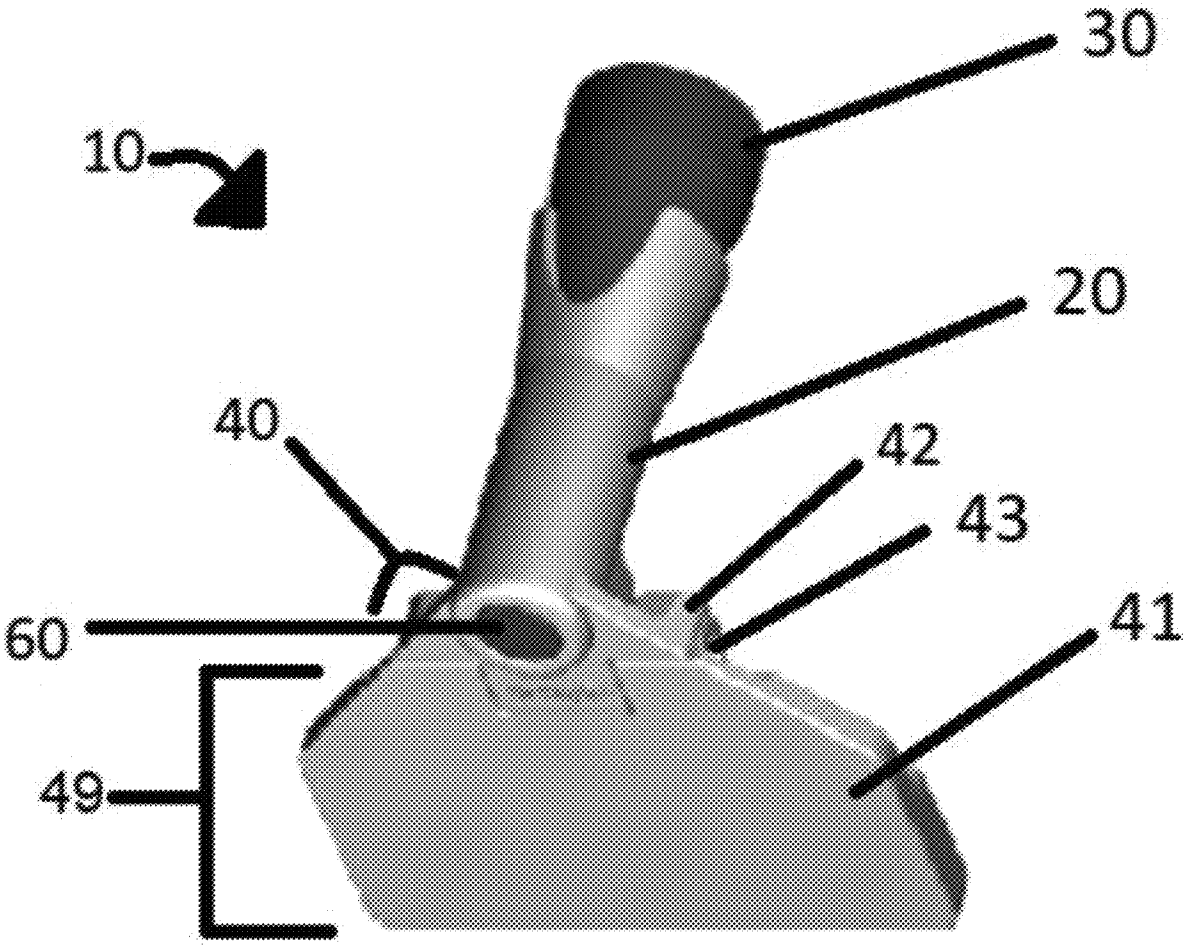
FIG. 1 illustrates an exemplary embodiment of the clipstand.

Particular embodiments of the present invention will now be described in greater detail with reference to the figures.

The present invention provides a clipstand apparatus 10 that attaches to a writing device, or other device with a barrel of similar shape and width of the writing device, and displays information on the clip panel 49 front surface either directly or by using the built in magnet 47 and a tag, a clear plastic sleeve with a strip of metal inside or adhered to the back of the sleeve to magnetically attach the sleeve to the magnet 47 of the clip panel 49. The sleeve can hold business or marketing cards or be written on directly with an erasable marker. The clipstand 10 is utilized by connecting an adapter 30 it to the top of a writing device and hinging the clip panel 49 open or closed (depending on the need). This allows for the front surface 41 of the clip panel 49 to be prominently displayed when placed on a flat surface as the clipstand 10 will cause the writing instrument to be propped up from the flat surface or table.

In the first embodiment, the clipstand 10 has a magnet 47 or magnets embedded in a back recess 48, or attached to the back, of the clip panel 49 which allow different displays to be magnetically attached to the front side of the clip panel 49 and be easily interchanged.

As shown in FIG. 1, the present invention provides a clipstand apparatus 10 comprised of an adaptor 30 that is secured into a collar 20 by a male assembly insert 60. The collar 20 is connected to the clip 49 by a mechanical assembly 40. In the present embodiment, the mechanical assembly 40, is comprised of a bar 43 and hinge 42. The hinge 42 and the bar 43 allow the clip panel 49 to be connected to the collar 20 in a movable configuration. The clip panel 49 can be moved into a vertical or horizontal position. When the hinge 42 is in a first or closed position the clip panel 49 is parallel to the collar 20 and allows the clip 49 to be used as a name tag or other use when the collar 20 and adaptor 30 are attached to a writing instrument that is in the users front pocket; or when the clipstand 10 is inside a user's blouse and the metal-backed tag is outside the user's blouse and they are connected together; or when a lanyard is attached to the clipstand 10 and simultaneously holding the Tag, Clipstand 10, and marker (or other similar dimensioned barreled instrument). When the hinge 42 is in a second or open position the clip panel 49 is perpendicular to the collar 20, and the clipstand apparatus 10 can be placed on a table and display information, an image, the sleeve or tag, used to prop a mobile device or tablet with a metal strip, or other metal-backed item.

Figure 2:
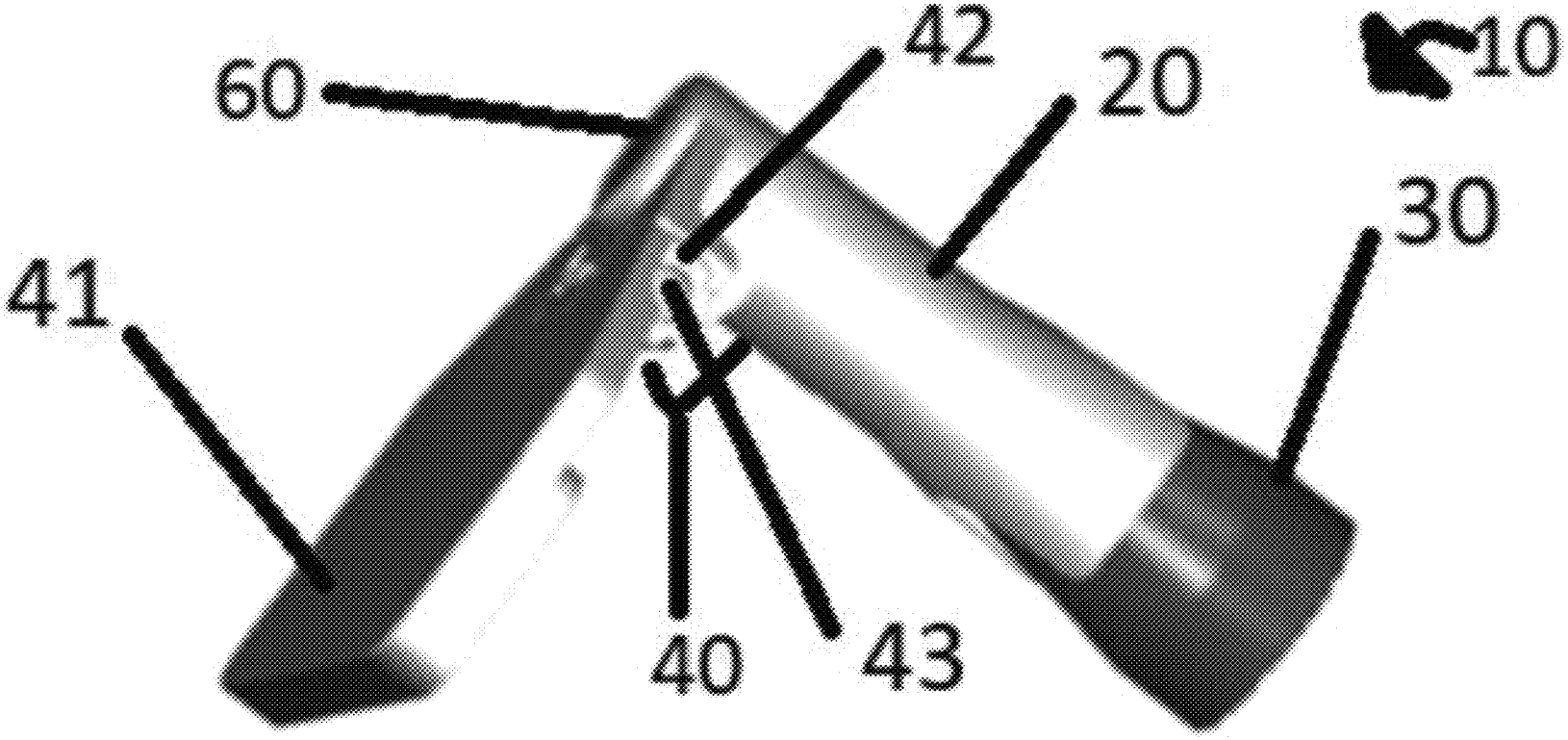
FIG. 2 illustrates an exemplary embodiment of the clipstand as it would sit on a flat surface.

FIG. 2 shows the open clipstand 10 as it would be displayed on a flat surface without being inserted on to a writing instrument. The hinge 42 is open in the $2^{nd}$ position making the front surface 41 of the clip perpendicular to the collar 20, and the front surface 41 of the clip is on display. The clip panel 49 and collar 20 are connected by the mechanical assembly 40 which in the preferred embodiment includes bar 43 positioned through hinge 42. The adaptor 30 is fitted into collar 20 and fastened to the assembly 40 by male assembly insert 6. When a writing utensil is inserted into the adaptor 30 the display angle will be adjusted depending on the size of the writing or other similarly barreled instrument.

Figure 3:
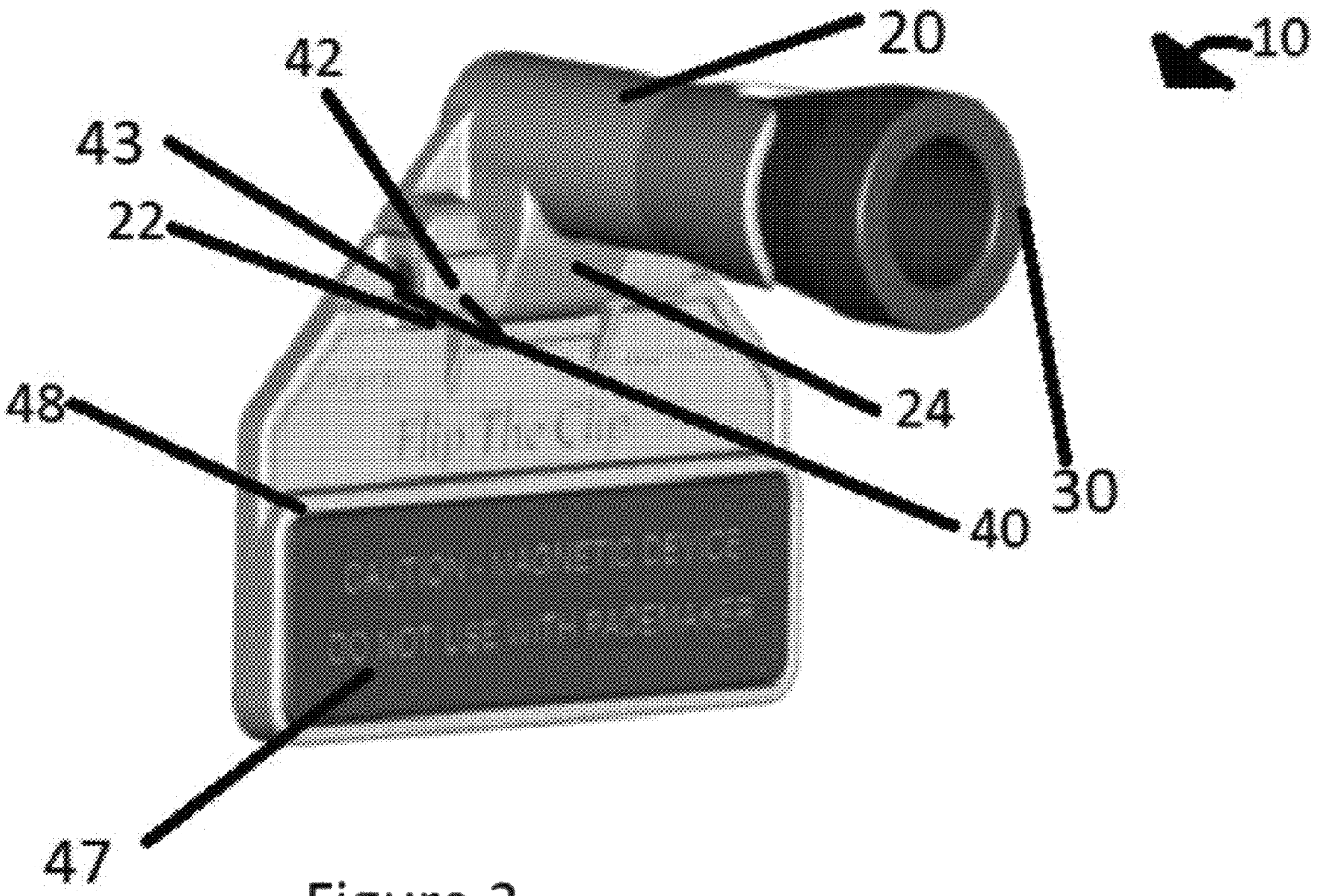
FIG. 3 illustrates rear view of the clipstand.

FIG. 3 shows the rear of the clipstand 10 in the open position. The collar 20 is attached to the clip panel 49 by mechanical assembly 40, comprised of a bar 43 going through a hinge 42. The hinge 42 sits on hinge lip 22 which is integrated into the collar 20 and includes a hinge recess 24. The rear surface 45 of the clip panel 49 has a magnet strip 47 embedded in or affixed in a magnet chamber 48. The magnet strip 47 allows different displays to be placed on the front surface 41 of the clip panel 49.

In an alternative embodiment, the clipstand apparatus 10 may have a tag, a clear plastic sleeve, (not shown) with a self-adhesive metal bar attached to the back of the sleeve so that the sleeve is attracted to the magnet 47, and sticks to the clip face 41. The tag has an opening on the top to allow for different designs or messages to be inserted inside of the sleeve and be displayed. The tag may also be marked with an erasable marker to alter or personalize cards placed in the sleeve. The self-adhesive metal bar may be attached to any flat surface to allow the display of various objects such as a phone, a miniature picture frame, a bottle opener, and LCD screen. Further any metal-backed object will be able to be displayed on the clip 49.

In a second or alternative embodiment, the mechanical assembly 40 includes a release configuration to allow the bar 43 to be removed from the hinge 42. The release configuration allows the clip panel 49 to be removed and used as a name tag in a user's pocket separate from the clipstand 10 or a lanyard. The unattached clip 49 with a magnet 47 located on the rear surface 45 of the clip panel 49 would be placed inside a user's pocket and the metal backed tag would be attracted to the magnet and placed on display on the outside of the user's pocket.

In order to serve different functions, the clip panel 49 itself may take many forms and shapes, including but not limited to a white board, bottle opener, a clasp (to grab and support a phone or tablet), a watch piece or clock, or a light. These items can be the clip itself, or attached to the clip panel using magnets, glue, Velcro, or a specifically shaped insert to lock into a receiving piece on various items. The clip can further include a specially shaped insert to lock into a receiving indentation in a cell phone or tablet case, an LCD screen, TV screen, or other Computer screen that can play movies, display pictures, be a phone/smart device display, etc. Further, utilizing the release configuration, the different clips can be interchangeable by removing the metal bar 43 from the hinge 42 and interchanging the different clips from the available clip display configurations. All interchangeable clips would incorporate a design to mate with the mechanical assembly 40 to allow the interchangeable alternative clip designs to be attached to the collar 20.

The clips may also be interchangeable using the ruggedized clip panel. The ruggedized clip panel is a second clip panel that attaches to the original clip panel 49. The original clip panel 49 slides into the ruggedized and snaps into place. The second clip panel allows for the user to permanently attach one of the many forms or shapes of the clip panel on an interchangeable surface, allowing the user to utilize different objects while using the same base clip panel 49.

The design could be modified such that the clip panel 49 is not hinged but is in a permanent open or closed position. For example, the bottle opener design could be in an open fixed position to allow for more rigidity and strength as might be required for removing bottle caps. In addition, additional designs and features could be integrated as part of the collar 20. For example, the collar 30 could be extended beyond the hinge assembly 40 allowing for additional features beyond the cap. Such additional features could include an integrated light, a bottle cap opener, a decorative top (i.e. flower), or an eraser (pencil or whiteboard).

The rear surface 45 of the clip panel 49 may have a magnet 47 embedded but does not need a magnet 47 to be used by or work with the various clip attachments or options (i.e. LCD screen, watch, etc.). The clip panel 49 may be designed with a ledge to work with a mobile device or other tablet or device case to prop the mobile device or tablet up, without the use of a magnet 47. The clip panel 49 ledge may be a raised ridge or tooth/teeth to support holding up a phone or tablet.

Figure 4:
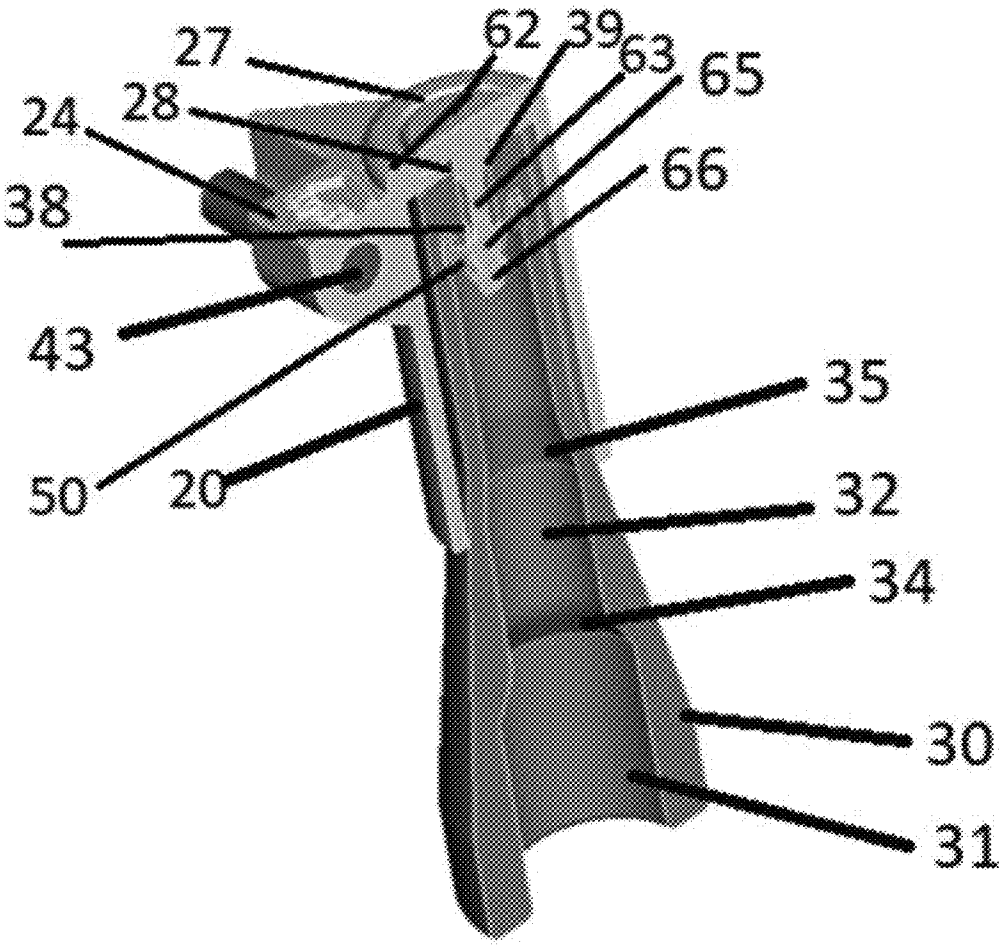
FIG. 4 illustrates the inside view of the clipstand collar and adaptor.

FIG. 4 illustrates how the adaptor 30 can attach to either side of different size writing utensils. The large grip 31 allows for writing utensils with a larger circumference, such as a marker, to be inserted into the adaptor 30 and stay attached. The first reduction 34 decreases the size of the inside surface of the adapter 30 and allows for the small grip 32 to attach to writing utensils with a smaller circumference (i.e. pencils). A second reduction 35 allows for even smaller circumference writing instruments to be inserted into the adaptor 30 and stay connected. The adaptor 30 is inserted into the collar 20 and held in place by a male assembly insert 60 (as seen in FIG. 6) and a small retaining piece 50. The male assembly insert 60 has a cap 62 that is inserted into recess 27 in collar 20. When the male assembly insert 60 is inserted into the recess 27 the male assembly base 63 is inserted into the small collar opening 28 (see FIG. 5). The male assembly insert 60 goes through the small collar opening 28 and through a top hole 39 in the adaptor 30. The male assembly insert 60 is locked into place with the retaining piece 50. FIG. 4 also shows the bar 43 going through the hinge recess 24 of the collar 20. The adapter is not limited to attaching to either side of pens and pencils, but may also be attached to stylus, pipe or other smoking apparatus, silverware, toothbrush, razor, or any instrument with a similar sized handle/barrel. While the adapter fits a variety of barreled instruments, the clipstand 10 does not need a barreled instrument to prop the phone and may be used as a display without the addition of a barreled instrument.

Figure 5:
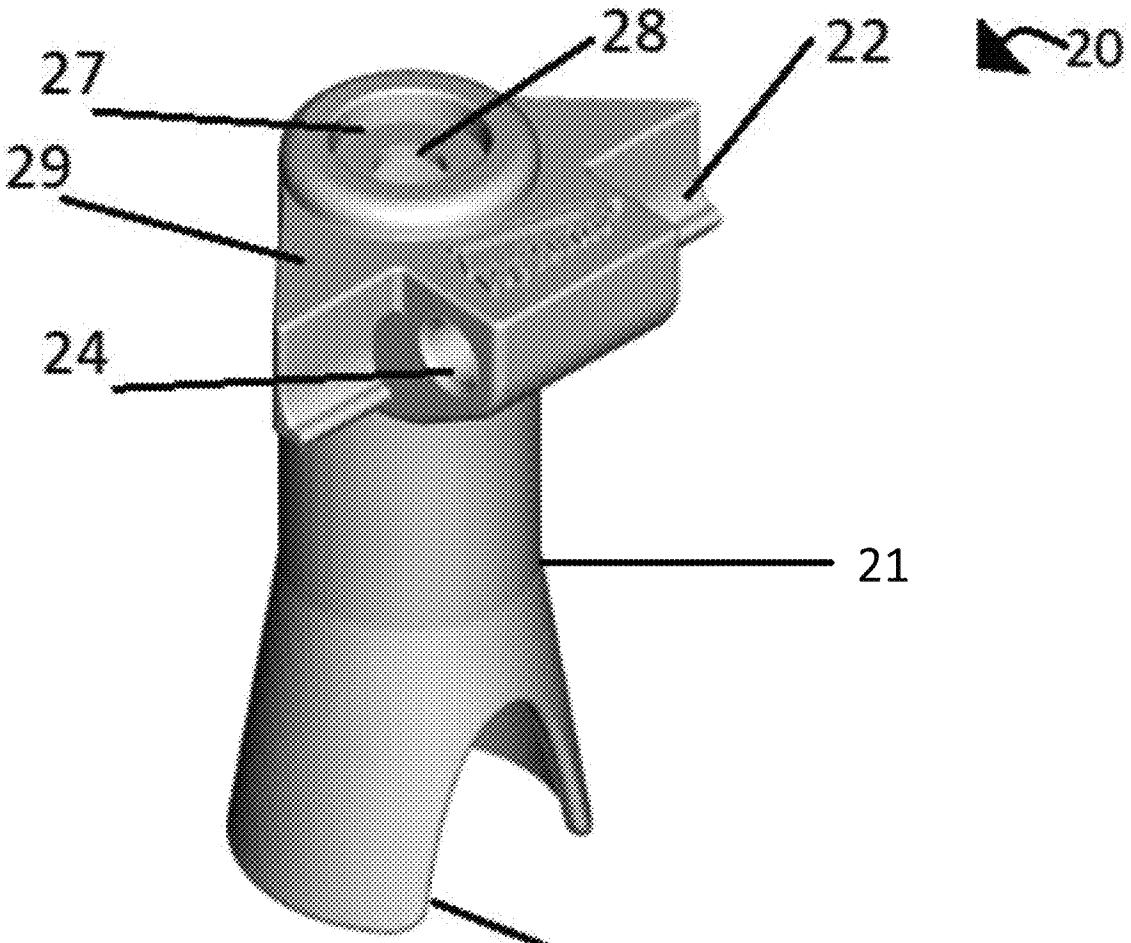
FIG. 5 illustrates the clipstand collar.
Figure 6:
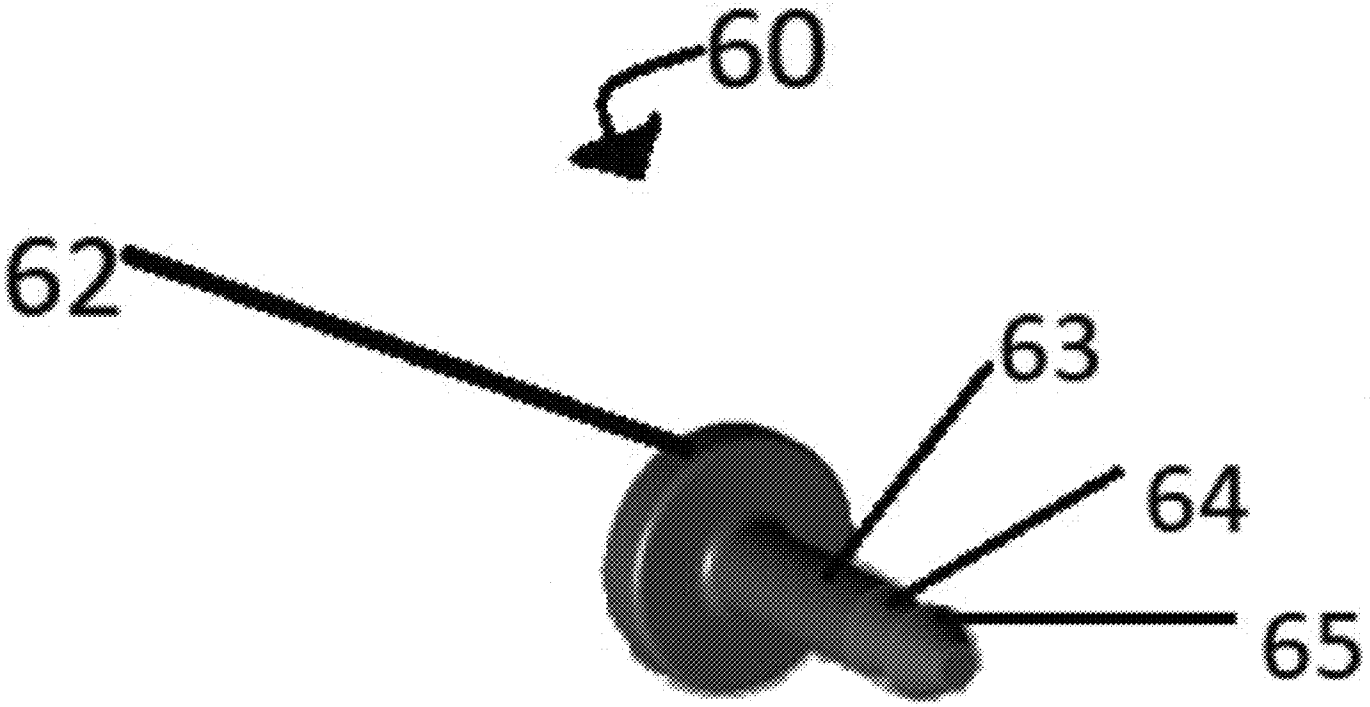
FIG. 6 illustrates the male assembly insert.

FIG. 5 shows the pieces of the collar 20. The collar 20 has a hinge lip 22 for the clip hinge 42 to sit on and the hinge recess 24 for the bar 43 to go through and attach the collar 20 and the clip 49. The collar has a reduction 21 decreasing the size of the collar 20 and allows for the flaring out of the adapter 30 as it changes size. The adaptor 30 fits into the bottom collar opening 25. Further, the male assembly 60 will be inserted through the small collar opening 28 and sit in the collar recess 27 on the collar top 29.

The male assembly insert 60 is shown in FIG. 6, and is comprised of a cap 62, a stem 63, a first ridge 64, and a second ridge 65. The first ridge 64 is created by the circumference of the stem 63 gradually decreasing, and then immediately returning to the stem's 63 original circumference. The second ridge 65 is created by the bottom of the first ridge returning to the stem's original circumference before narrowing the stem's circumference base again.

In another embodiment of present invention, the male assembly insert 60 may be hollow to allow for objects to be inserted inside the male assembly insert 60 and displayed. Objects which may be inserted into a hollow male assembly insert 60 may include an eraser, or a decorative clip/design piece. The hollow male assembly insert 60 will also allow users using a smoking apparatus as the barreled support instrument inserted into the adapter 30 to inhale through the male assembly insert 60.

In another embodiment of the present invention, the male assembly insert cap 62 may be a stylus tip.

Figure 7:
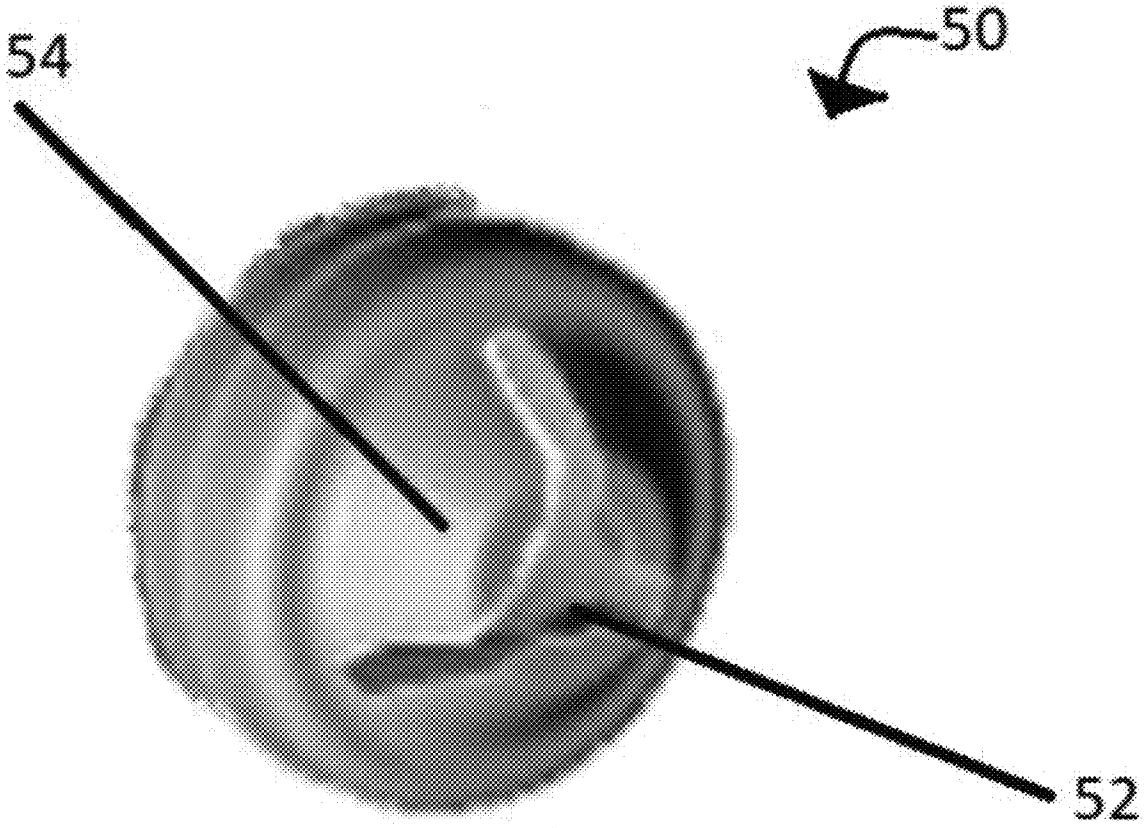
FIG. 7 illustrates the small retaining piece.

FIG. 7 shows the small retaining piece 50 that will lock the male assembly insert 60 in place. The retaining piece 50 has a circular opening 52 with three (3) notches 54 at the bottom of the retaining piece 50. The male assembly insert 60 is pushed through the small retaining piece 50 and the circular opening 52 locks the male assembly insert 60 in place. The small hole 52 with the three notches 34 allows the second ridge 65 to go through the circular opening 52 but locks the male assembly insert 60 into place because it cannot be removed from the retaining piece 50 due to the narrow circumference of the stem 63 between the first ridge 64 and the larger circumference of the top of the second ridge 65.

Figure 8:
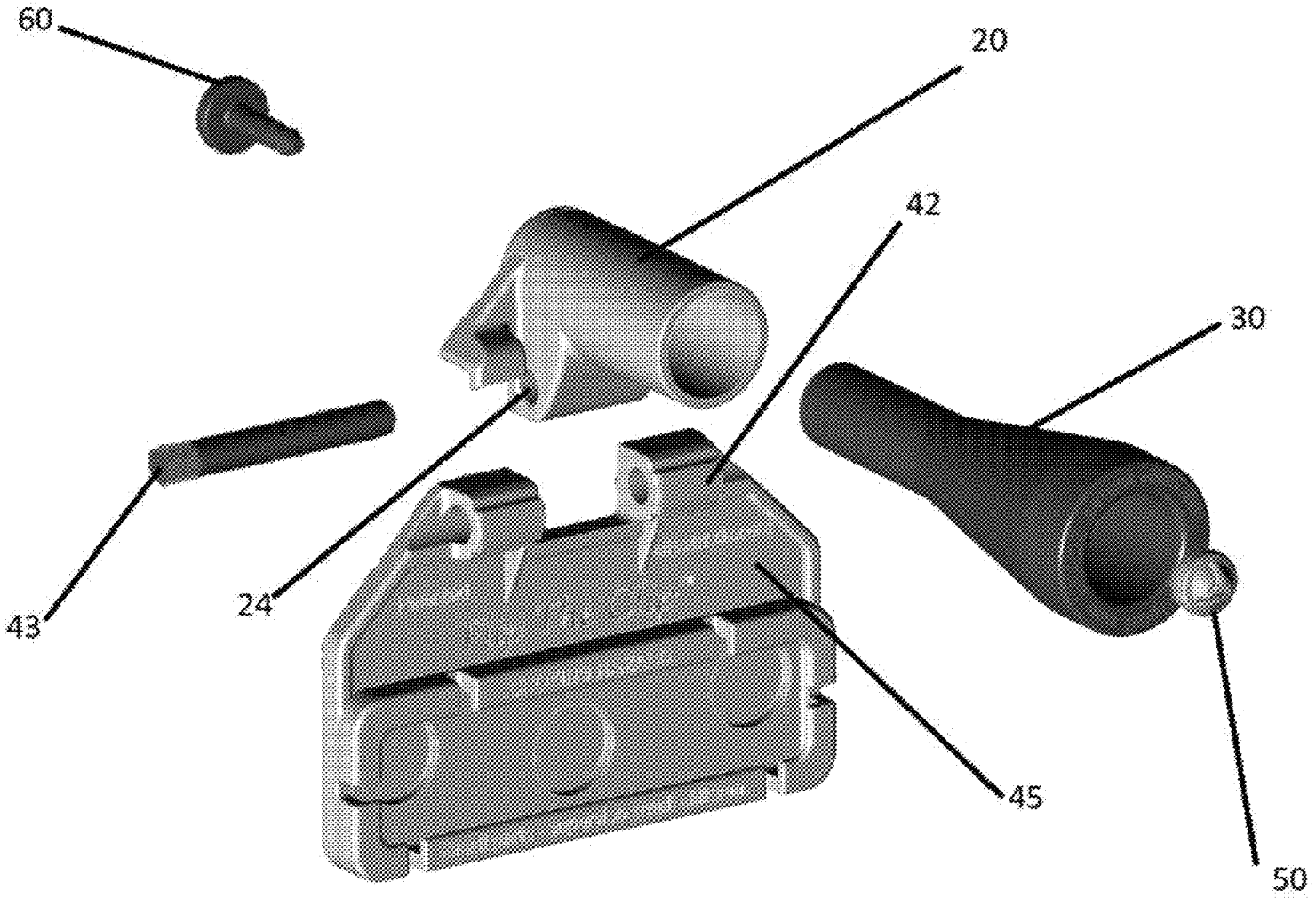
FIG. 8 illustrates a blown-out schematic of the clipstand.

FIG. 8 shows all the pieces of the clipstand assembly 10. The bar 43 is inserted into the hinge 42 of the rear surface of the clip 45 and the hinge recess 24 of the collar 20 to form a completed unit. The adaptor 30 will be inserted into the collar 20 and held in place by the male assembly insert 60 being inserted into the collar 20 and the adaptor 30, and fixed into place with the small retaining piece 50.

Figure 9:
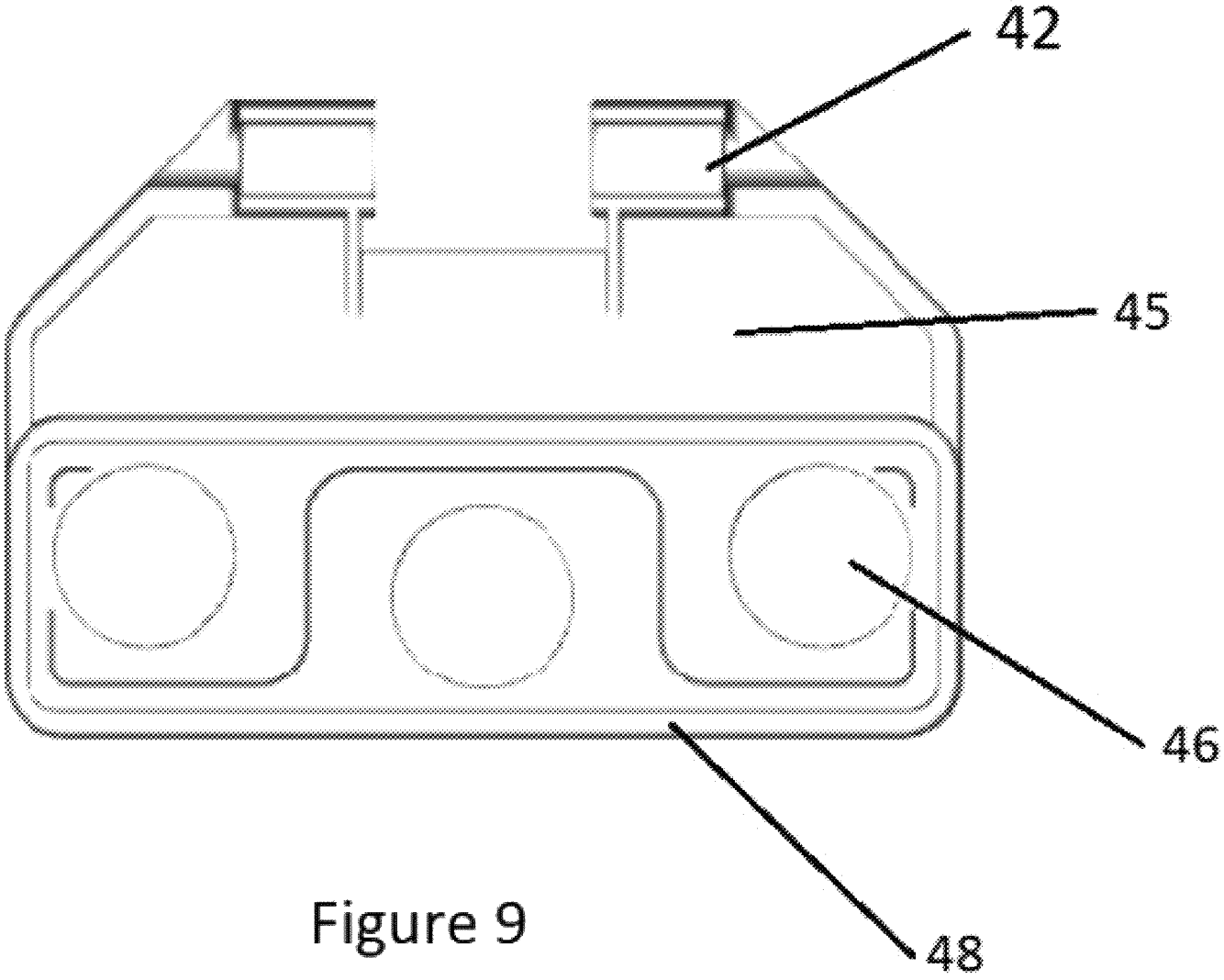
FIG. 9 illustrates a rear view of the clip surface.

FIG. 9 shows a rear surface of the clip 45. The magnets 46 are under the magnet strip 47 indicated in FIG. 3. The magnet strip 47 lies in the magnet chamber 48 and secured by methods including but not limited to sonic welding to ensure the magnet does not fall out of the magnet chamber 48. The insertion of the magnets 46 into the magnet chamber 48 are not limited to what is depicted in the figures. The clip surface 41 will be attached to the collar 20 by hinge 42 and bar 43 and hinge recess 24 shown in FIG. 8

Figure 10:
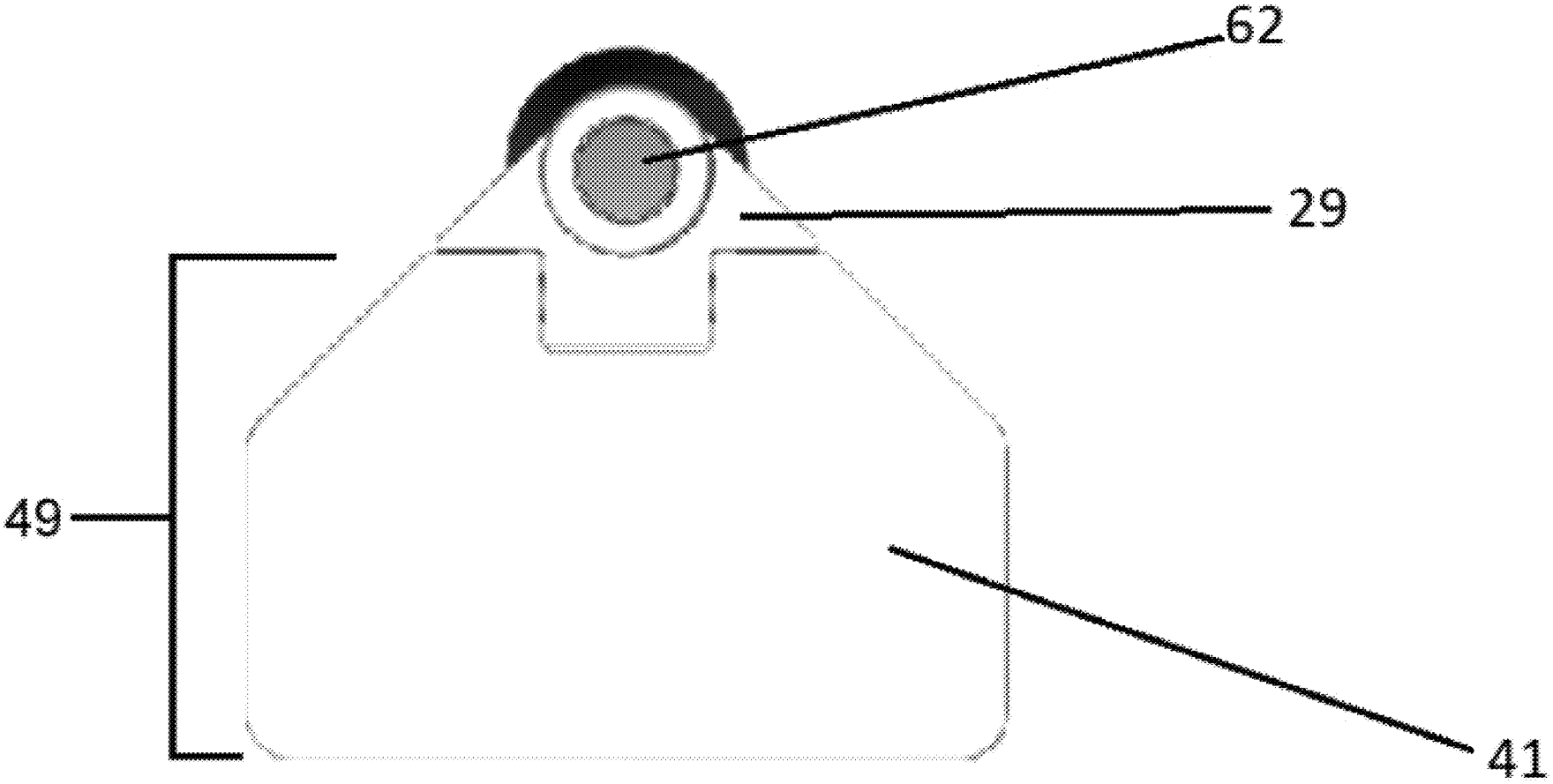
FIG. 10 illustrates a front view of the clip surface.

FIG. 10 shows the front view of the clipstand apparatus 10. The clip 49 is attached to the collar 20 by the collar top 29 and male assembly insert cap 62. The clip 49 may have a design on it or have a tag, plastic sleeve with a metal bar affixed to its back (not pictured), stuck on it. The clip 49 may act as a name tag when the hinge is in a down position and the collar 20 and adapter 30 are attached to a pen in the user's front pocket, through their blouse as a magnetic nametag or hung via a lanyard. The clip 49 may also act as a display when it is placed on a table with the hinge 42 open.

The clipstand apparatus 10 may not only be used as a display tool but may also be used to prop up a phone. By attaching a metal self-adhesive strip to the back of a phone or a magnetic plate in the phone case, the magnetic face of the clip surface attracts the strip and allows a phone to propped up for ease of viewing. Further the clipstand apparatus 10 may also be used as a fidget toy. Users may flip open and shut the clip panel 49, or cap and uncap the adapter on a barreled object, or slap a magnet on the clip face 41. The metal backing that attaches to the back of the users phone to allow for the phone to attach to the clipstand 10 via magnets may also be used to turn the phone into a fidget toy. When the self-adhesive metal bar is attached to the users phone, the phone can spin on a flat The clipstand apparatus 10 with the use of the second ruggedized version of the clip panel may stick to the car dashboard, or an airplane tray. In the ruggedized version there is a self-adhesive "Lock" (ruggedized holder) into which a clipstand that can be inserted and secured to whatever object to which the lock is attached. The lock with self adhesive can be stuck to the back of a tablet or tablet case, and then the Clipstand can be inserted into the lock for a secure attachment. By doing this, a user may secure his/her stylus to his/her tablet (tablet case), prop up a heavier gadget (a tablet), secure to the back of an airplane seat, a car dashboard etc. Further, the lock can release the Clipstand and accompanying instrument, if there is one. This is meant for repeatedly removable secured and released attachments.

It will be recognized by those skilled in the art that changes, or modifications may be made to the above described embodiment without departing from the broad inventive concepts of the invention. It is understood therefore that the invention is not limited to the particular embodiment which is described but is intended to cover all modifications and changes within the scope and spirit of the invention

I claim:

1. A holding device comprising:

a flexible adapter having a first adapter opening on a first adapter end and a second adapter opening on a second adapter end;

a collar having a first collar opening on a first collar end, a second collar opening on a second collar end, and a hinge recess on the second collar end;

a male insert retaining piece;

wherein the second collar opening is configured to receive the first end of the flexible adapter and the first collar opening is configured to receive the second end of the male insert retaining piece;

wherein the adapter end is inserted into the collar and retained in the collar by the male insert;

wherein the first adapter opening is configured for receiving a barreled instrument; and a panel connected to the collar.

2. The holding device of claim 1, further comprising a retaining piece having a circular opening, wherein the retaining piece is inserted into the adapter and configured to fasten to an end of the male insert retaining piece.

3. The holding device of claim 1, wherein the panel is connected to the second collar end by a hinge.

4. The holding device according to claim 3, wherein the panel is interchangeable through the hinge pin and hinge recess.

5. The holding device of claim 1, wherein the panel has a magnet embedded in a rear surface.

6. The holding device of claim 1, further comprising a ruggedized holder for receiving the panel, wherein the holder is configured to allow the panel to be released from the holder.

7. The holding device of claim 6, wherein the holder may be attached to at least one object for allowing releasable attachment of the holding device to the at least one object.

8. The holding device of claim 7, wherein the holder is attached to the at least one object by adhesive.

9. The holding device of claim 1, wherein the second adapter opening of the second adapter end can accommodate a plurality of objects inserted into the second adapter opening.

10. A holding device comprising:

a flexible adapter having a first adapter opening on a first adapter end, a second adapter opening on a second adapter end, and an adapter hollow channel from the first adapter opening to the second adapter opening;

a collar having a first collar opening on a first collar end, a second collar opening on a second collar end, and a collar hollow channel from the first collar opening to the second collar opening;

a male insert having a first insert opening on a first insert end, a second insert opening on a second insert end, and a insert hollow channel from the first insert opening to the second insert opening;

wherein the first adapter end is inserted into second collar end;

wherein the second insert end is inserted into the first collar end and mates with the first adapter end to retain the flexible adapter in the collar; and wherein when the holding device is assembled the holding device has a device channel running the length of the holding device from the second end of the adapter to the first end of the male insert.

11. The holding device of claim 10, further comprising:

a retaining piece having a circular opening with at least one retaining element;

wherein the retaining element is inserted into the flexible adapter and mates with the second insert end to retain the insert thereby retaining the adapter in the collar.

12. The holding device of claim 10, wherein the adapter has at least one circumferential reduction between the first adapter end and the second adapter end.

13. The holding device of claim 10, wherein the collar has at least one circumferential reduction between the first collar end and the second collar end.

14. The holding device of claim 10, wherein the holding device is used to inhale through the hollow device channel for use with a smoking material.

15. The holding device of claim 10, wherein the holding device is used to inhale through the hollow device channel for use when a smocking apparatus is inserted into the second adapter opening.

* * * * *